United States Patent [19]

Eblen et al.

[11] 4,346,846

[45] Aug. 31, 1982

[54] FUEL INJECTION NOZZLE

[75] Inventors: Ewald Eblen, Stuttgart; Karl Hofmann, Remseck, both of Fed. Rep. of Germany

[73] Assignee: Robert Bosch GmbH, Stuttgart, Fed. Rep. of Germany

[21] Appl. No.: 213,714

[22] Filed: Dec. 5, 1980

Related U.S. Application Data

[63] Continuation of Ser. No. 42,259, May 24, 1979, abandoned.

[30] Foreign Application Priority Data

Jun. 14, 1978 [DE] Fed. Rep. of Germany ..... 2826038

[51] Int. Cl.[3] ..... F02M 61/16

[52] U.S. Cl. ..... 239/533.3

[58] Field of Search ..... 239/453, 456, 533.3–533.12, 239/584, 600; 285/23, 305, 353, 356

[56] References Cited

U.S. PATENT DOCUMENTS

| | | | |
|---|---|---|---|
| 2,244,394 | 6/1941 | Hautzenroeder | 239/533.8 X |
| 2,310,490 | 2/1943 | Melsom | 285/356 X |
| 2,428,077 | 9/1947 | Herold | 285/353 X |
| 3,527,485 | 9/1970 | Goward et al. | 285/305 |
| 3,788,546 | 1/1974 | Bailey et al. | 239/533.11 X |

FOREIGN PATENT DOCUMENTS

| | | | |
|---|---|---|---|
| 335074 | 3/1921 | Fed. Rep. of Germany | 239/453 |
| 840236 | 4/1939 | France | 239/453 |
| 961531 | 5/1950 | France | 239/533.3 |
| 345495 | 5/1960 | Switzerland | 239/453 |
| 467124 | 10/1936 | United Kingdom | 239/533.7 |

*Primary Examiner*—Johnny D. Cherry
*Attorney, Agent, or Firm*—Edwin E. Greigg

[57] ABSTRACT

The invention proposes a fuel injection nozzle wherein the mounting, for example in the form of a cap nut or sleeve nut, used for clamping the fuel pressure line to the nozzle holder, is replaced by a cap screw, the outer thread of which engages a corresponding threaded area in the engine bore which is arranged to receive the nozzle. This has the result that, together with the mounting of the fuel line, the injection nozzle is simultaneously firmly clamped to the engine.

9 Claims, 4 Drawing Figures

FUEL INJECTION NOZZLE

This is a continuation, of Application Ser. No. 42,259, filed May 24, 1979, now abandoned.

BACKGROUND OF THE INVENTION

The invention is based on a fuel injection nozzle as described herein and finally claimed. Generally, fuel injection nozzles are clamped to the internal combustion engine by way of a hollow screw, the arrangement being such that the hollow screw engages a corresponding shoulder of the nozzle holder. The nozzle holder, during the fastening step, rests, in turn, on a shelf portion in the bore of the internal combustion engine, which bore houses the fuel injection nozzle. The fuel line is, in such instances, connected to the nozzle holder invariably by means of a cap nut which engages a thread of the nozzle holder. This conventional design for mounting the fuel injection nozzle on the engine and for attaching the fuel line to the nozzle is relatively expensive in its manufacture and time-consuming during assembly.

OBJECT AND SUMMARY OF THE INVENTION

The fuel injection nozzle of this invention has, as contrasted to the above, the advantage that the fuel line can be attached to the fuel injection nozzle, and the latter can be attached to the engine, by the mounting of a single screw connection. Accordingly, less components are required from a manufacturing viewpoint and as a consequence, the design is very economical.

By the further developments and/or embodiments of the invention set out in the dependent claims, an advantageous demounting of the nozzle from the nozzle-housing bore in the internal combustion engine is especially provided. As is known, after a certain operating period, the nozzle seizes or becomes locked, with its section facing the combustion chamber, within the bore housing the nozzle. Frequently a special tool must be employed to extract the nozzle out of the bore, and this operation is often carried out with considerable difficulties. According to the invention, the extraction of the nozzle from the engine takes place via the same thread with which the nozzle had previously been clamped in position.

DESCRIPTION OF THE EMBODIMENT

Figure 1:
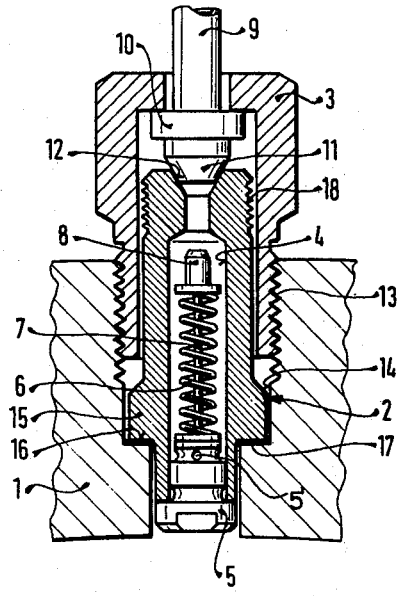
FIG. 1 is a cross-sectional view of the first embodiment of the invention.
Figure 5:
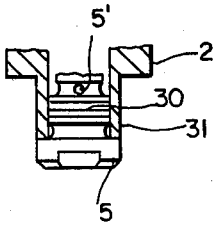
FIG. 5 is a partial cross-sectional view of the nozzle body having screw threads.

As shown in FIG. 1, a nozzle holder 2 is clamped firmly in the wall of an internal combustion engine 1 by means of a hollow screw 3 which serves as the mounting means therefor. From the side of the combustion chamber, a nozzle body 5 is pressed into the end of nozzle holder 2 as shown in FIG. 1 or screw threaded into the end of the nozzle as shown in FIG. 5 and extends into the interior 4 of the nozzle holder 2 and is provided with control orifices 5'; this nozzle body being part of a preassembled valve module. The valve module, in addition to the nozzle body 5, comprises a closing spring 6 which encircles an outwardly opening valve needle 7 and is interposed between an abutment 8 connected with the valve needle 7 and a shelf portion of the nozzle body 5. On the side of the nozzle holder 2 which faces away from the nozzle body 5, a fuel feed line 9 is connected to the nozzle holder. For this purpose, a thrust ring 10 is provided on the fuel line 9, the hollow screw 3 being arranged to engage this thrust ring. The feed line 9 has a conical orifice or tip 11 clamped, after assembly, on a conical seat 12 of the nozzle holder 2. During the mounting of the injection nozzle and feed line 9, the hollow screw 3 is threaded by means of a threaded area 13 into the threaded bore 14 of the housing 1 of the internal combustion engine, this bore housing the injection nozzle. While the hollow screw 3 is inserted, the nozzle holder 2 is pushed into the bore 14 by means of the thrust ring 10 of the feed line 9 and the orifice 11, until the nozzle holder, which includes a dependent shoulder, rests on a shelf portion 16 of the bore 14. Advantageously, a sealing means 17 is provided on this shelf portion 16. Thus, by means of the hollow screw 3, the feed line 9 and the nozzle holder 2 are simultaneously clamped in position.

In the first variant of the embodiment, the nozzle holder 2 is provided at its upper extremity with a thread 18. Thus, once the hollow cap screw 3 is removed and the fuel feed line is removed from the nozzle holder 2, a tool can be applied to the threaded area 18 to demount the seized nozzle.

Figure 2:
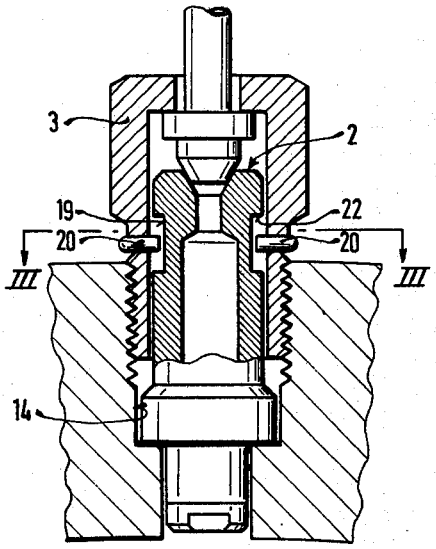
FIG. 2 is another cross-sectional view of a further embodiment of the invention.
Figure 3:
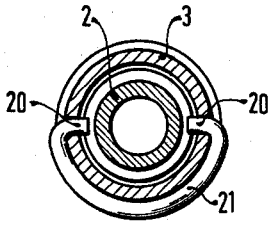
FIG. 3 is a view along the line III—III of FIG. 2.

FIG. 2 shows the second variant of the embodiment, which is a modification of the concept of a device for detaching the nozzle. For this purpose, this area of the fuel injection nozzle is illustrated on an enlarged scale. In place of the threaded area 18 in FIG. 1, an annular groove 19 is provided on the upper section of the nozzle holder and this area may be engaged by radial pins 20 which are guided in the hollow screw 3. As can be seen from the corresponding cross-section of the fuel injection nozzle shown in FIG. 3, these pins 20 are part of a clip 21 which is snapped into position after the hollow screw 3 has been placed over the nozzle holder 2. During the demounting of the hollow screw 3 from the bore 14 of the internal combustion engine, the radial pins 20 engage the boundary wall 22 of the annular groove 19 of the nozzle holder 2, this wall being located at the end face of the groove. The pins thus pull the fuel injection nozzle out of the bore 14 simultaneously with removal of the cap nut 3.

Figure 4:
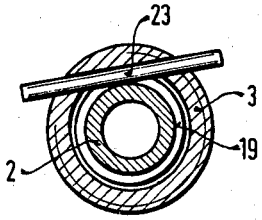
FIG. 4 is another embodiment of the invention revealing a tangential pin used in lieu of the clip of FIG. 3.

In the third variant of the embodiment shown in FIG. 4, a pin 23 is likewise arranged to engage the annular groove 19 of the nozzle holder 2. However, as contrasted to the previous modification, this pin 23 is tangent to the nozzle holder in the groove 19, but likewise penetrates the wall of the cap nut 3. Accordingly, removal of the nozzle takes place, in principle, as in the embodiment of the invention shown in FIGS. 2 and 3.

The invention is not limited exclusively to nozzles opening in the flow direction, but is likewise applicable to nozzles with valve needles which open in opposition to the flow. The important aspect is that a clamping connection is provided for between the respective elements, i.e., the feed line and the nozzle holder, and the installation and removal of these elements from the internal combustion engine by means of the cap nut 3 that is used to fasten the feed line 9.

FIG. 5 illustrates a partial cross-sectional view of the nozzle body 5. In this modification, the nozzle body 5 includes screw threads 30 thereon which thread into the threaded end 31 of the nozzle holder 2. Thus, the nozzle body 5 is threaded into the end of the nozzle holder 2 rather than pressed in as in the modification shown in FIG. 1.

What is claimed and desired to be secured by Letters Patent of the United States is:

1. Fuel injection nozzle having a fuel inlet end and a fuel injection end for internal combustion engines arranged to be supported in a bore of the internal combustion engine, further including a nozzle holder, said nozzle holder including an axially aligned bore therein and extraction means on its upper extremity for removal of said nozzle holder from said bore of said internal combustion engine, said extraction means including at least one groove in said upper extremity, a preassembled valve module secured in the bore of said nozzle holder from the injection side of said injection nozzle and an exteriorly threaded cap for clamping a fuel feed line to said nozzle holder, further wherein said internal combustion engine bore is threaded and arranged to receive said exteriorly threaded cap whereby said fuel feed line is clamped to said nozzle holder in an end-to-end pressure-tight fit and said nozzle holder is locked in said bore of said internal combustion engine.

2. Fuel injection nozzle according to claim 1, further wherein said preassembled valve module comprises a nozzle body provided with radially extending control orifices, a closing spring, a needle-connected abutment and a valve needle.

3. Fuel injection nozzle according to claim 2, further wherein said valve module is threadedly connected to said nozzle holder.

4. Fuel injection nozzle according to claim 1, further wherein said extraction means includes an exteriorly threaded portion.

5. Fuel injection nozzle according to claim 1, further wherein said nozzle holder extraction means includes an annular recessed collar, said exteriorly threaded cap has a proximate boundary wall and a clip associated with said cap has leg portions that extend into said recessed collar.

6. Fuel injection nozzle according to claim 1 further wherein said nozzle holder extraction means includes a recessed groove in its upper extremity, whereby a tangentially disposed pin extending through said cap is arranged to cooperate with said recessed groove.

7. Fuel injection nozzle as claimed in claim 1 further wherein said nozzle holder extraction means includes an annular groove and pin means for penetrating said cap for engaging said annular groove of said nozzle holder extraction means.

8. Fuel injection nozzle as claimed in claim 7 further wherein said pin means is formed by a spring clip placed around said cap.

9. Fuel injection nozzle as claimed in claim 7 further wherein said pin means is an elongated straight pin which engages said annular groove tangentially.

* * * * *